United States Patent [19]

Murka, Jr. et al.

[11] Patent Number: 4,565,735

[45] Date of Patent: Jan. 21, 1986

[54] PAPERMAKERS' FELT

[75] Inventors: August Murka, Jr., Arnprior; Michael Marcellus, Sandpoint, both of Canada

[73] Assignee: Huyck Corporation, Wake Forest, N.C.

[21] Appl. No.: 621,503

[22] Filed: Oct. 19, 1984

[30] Foreign Application Priority Data

Oct. 19, 1983 [CA] Canada ..... 439316

[51] Int. Cl.[4] ..... B32B 7/02

[52] U.S. Cl. ..... 428/234; 28/107; 156/308.2; 156/309.6; 428/235; 428/236; 428/286; 428/287; 428/288; 428/296; 428/300; 428/301

[58] Field of Search ..... 428/234, 235, 236, 286, 428/287, 288, 300, 301, 296; 28/107, 112; 156/272, 308.2, 309.6

[56] References Cited

U.S. PATENT DOCUMENTS

| | | | |
|---|---|---|---|
| 2,336,797 | 12/1943 | Maxwell | 428/296 |
| 2,418,904 | 1/1947 | Rugeley | 428/296 |
| 2,528,129 | 10/1950 | Francis | 428/235 |
| 3,324,609 | 6/1967 | Stein | 156/148 |
| 3,329,554 | 7/1967 | Hencken | 428/235 |
| 3,613,258 | 10/1971 | Jamieson | 34/95 |
| 3,616,160 | 10/1971 | Wincklhofer | 428/296 |
| 3,928,699 | 12/1975 | Fekete | 428/212 |
| 4,107,367 | 8/1978 | Fekete | 428/234 |
| 4,119,753 | 10/1978 | Smart | 428/235 |
| 4,151,323 | 4/1979 | Christie | 156/143 |
| 4,382,987 | 5/1983 | Smart | 428/296 |

*Primary Examiner*—Marion C. McCamish

*Attorney, Agent, or Firm*—Pahl, Lorusso & Loud

[57] ABSTRACT

A papermaker's felt is formed by needling a compressible batt layer onto one or both sides of a base layer woven fabric. The batt layer is formed from a mixture of at least two types of fibers. A first type is present in much smaller quantities than the remainder and has a melting point at a temperature below the melting point of the remainder. The felt is heated to a temperature between the melting point of the first type of fibers and the remainder, so as to melt the first type such that it bonds the remainder together and to the base fabric. The felt is then formed into an endless belt.

13 Claims, 4 Drawing Figures

PAPERMAKERS' FELT

BACKGROUND OF THE INVENTION

The field of this invention is press felts for use in papermaking machinery, and more particularly press felts for use in the press section of a papermaking machine.

Generally, press felts are used in papermaking machines to support the moist, freshly formed paper web as it encounters a variety of rolls which serve to extract water from the moist paper web. In addition to serving as a support for the paper web, the press felt serves as a receptacle for the water removed from the paper sheet. Thus, it is desirable that the felt contain voids to hold the water removed from the web. The press felt is normally joined into an endless conveyor belt-like shape and during the various operations previously described, a large amount of water builds up in the press felt. The water is removed by suction or various other drainage devices, usually after the paper web and press felt are no longer in direct contact.

In addition to removing water from the web, the press felt also transports the web and drives the press rolls. Because the felt functions as a drive means, there are advantages to forming a portion of the felt from a material that is relatively incompressible. Incompressible materials contribute to the longevity of the fabric's useful life. However, incompressible materials so not normally exhibit those properties required for good removal of the water from the web. For this reason, it has been a common practice to provide a felt with a compressible paper-contacting layer (a batt) which is adhered to an incompressible base fabric. The base fabric does not contact the paper web. It is also possible to provide a compressible roll-contacting layer, adhered to the side of the incompressible base fabric opposite the paper-contacting batt. Thus the woven base layer is sandwiched between the paper-contacting batt or layer and the roll-contacting batt or layer.

Prior art felts suffer from the disadvantage that over time, the constituents of the paper contacting layer are caused by vibration to settle into a more compact configuration, thus reducing the drainage capacity of the felt. Further, the fibers of the prior art papermaking felts tend to loosen from the base layer, come free of the felt and contaminate both the paper web and the working environment.

Accordingly, the present invention achieves the following objects: to provide a papermaker's felt with more efficient drainage and wear resistance characteristics and that better resists compaction and fiber shedding.

SUMMARY OF THE INVENTION

These and other objects, as will be apparent to those skilled in the art, may be achieved from the practice of this invention. A papermaker's felt with more efficient drainage characteristics is achieved in accordance with the present invention by a construction which includes a paper-contacting layer of batt having a network of fused fibers which bond non-fused fibers to each other and to the base fabric. The network is formed by fusing low melting point material to high melting point fibers. A roll contacting layer formed in the same manner may be advantageously employed in the felt of the present invention.

This papermaker's felt may be made by blending a controlled quantity of nylon fibers with a controlled quantity of polypropylene and carding the blend onto a woven base fabric to form a paper-contacting batt. The batt is needled to the base fabric, cured, to melt the low melting point fibers, stretched to a predetermined thickness and quenched in order to hold the predetermined thickness. The felt is then joined into an endless belt. A roll-contacting batt may also be formed according to the same manner.

DESCRIPTION OF THE PREFERRED EMBODIMENT

Figure 1:
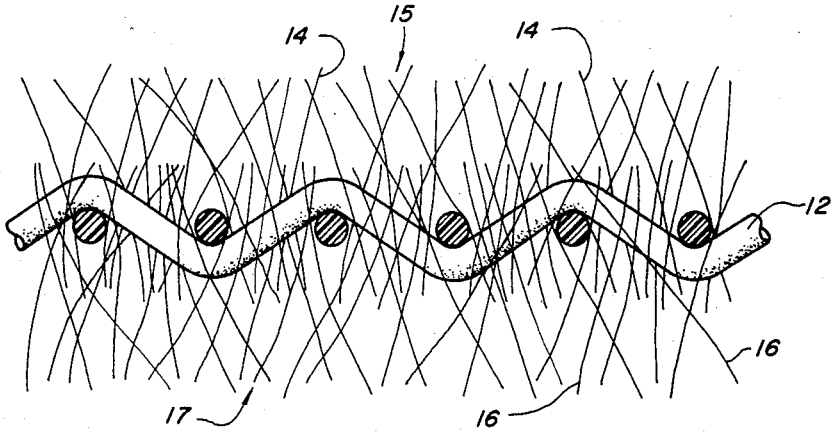
FIG. 1 is an enlarged scale, schematic cross-sectional view of a portion of the felt before curing, showing the several types of fibers needled through the base fabric. Fibers have been needled through from both directions in order to form both a paper-contacting batt and a roll-contacting batt.

FIG. 1 is a cross-sectional view of a portion of a felt prepared according to the invention before the felt has been heated. With specific reference to FIG. 1, the compressible layer of this invention is deposited on and directly joined to a base fabric (12). This base fabric comprises an incompressible woven or non-woven fabric which is made in accordance with any of a number of techniques that are well known in the art. (The drawing depicts a woven fabric.) The base layer may be formed from natural materials including animal fibers such as wool, as well as synthetic fibers such as polyacrylics, polyester, and nylons. The paper-contacting layer may be joined to the base layer by any conventional means such as needling in a needle loom or by the use of adhesives. However, needling is preferred. The terms "paper-contacting layer" or "batt" mean the layer of the felt which comes into contact with the paper web.

The paper-contacting layer or batt is composed of a controlled quantity of two or more materials to produce a continuous phase and a discontinuous phase. As used herein, a "continuous phase" refers to a network of material where every portion of that material contacts another portion of the same material such that a continuous path can theoretically be followed connecting all portions of the material, without passing through any regions that do not contain the material. A "discontinuous phase" refers to a network of material through which such a connecting path cannot be followed.

The preferred manner of achieving the continuous and discontinous phases is to utilize a relatively small amount by weight of fusible material having a relatively low melting point, in combination with a relatively large amount by weight of fibers having a relatively high melting point. The melting points of both the high melting point fibers and the fusible material, must be higher than the highest expected normal operating temperature of the papermaking machine. The batt is joined to the base fabric, either by needling, adhesive, or other conventional means. FIG. 1 shows fibers (14) which have been needled through the base layer from the top side (15) and fibers (16) which have been needled through from the bottom side (17). Fibers (14) and (16) each include both fibers of the fusible material and high melting point fibers.

Figure 2:
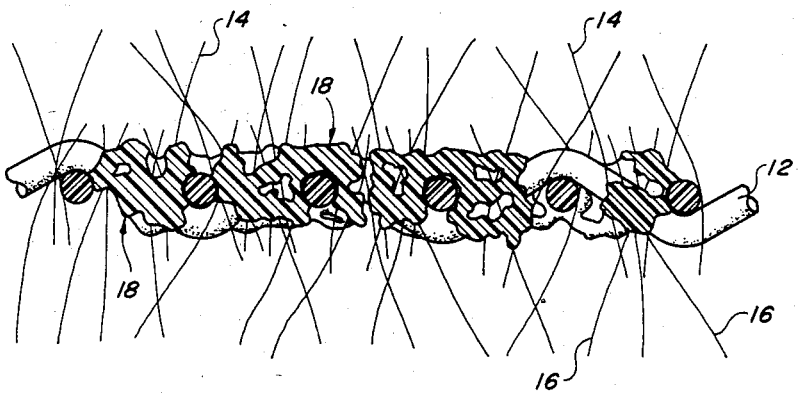
FIG. 2 is an enlarged scale, schematic, cross-sectional view showing the felt of FIG. 1 after it has been cured and the low melting point material has melted.

With reference to FIG. 2, after the batt is joined to the base fabric, the felt is heated to a temperature higher than the melting temperature of the fusible material but less than the melting temperature of the fibers having the relatively high melting point. This causes those fibers (14) and (16) which are fusible to melt together forming a continuous phase (18), which fuses to those fibers (14) and (16) having the relatively high melting point and also to the base fabric (12). Thus, the material having the relatively low melting point forms a continous phase (18) and the fibers with the relatively high melting point (14) and (16) form a discontinous phase. After the felt is treated, as described above, the material comprising the continuous phase shrinks, thus creating channels in the batt for water to pass through. In addition, the fusing of the fibers results in improved fiber connection to each other and the base fabric. This improved connection results in a felt that is more stable under vibration and resistant to shedding. Because the fibers are positively adhered to each other, they resist settling and thus compaction. Similarly, the adhesion reduces the tendency of the fibers to pull loose from the felt, thereby reducing the shedding of fibers from the felt.

Figure 3:
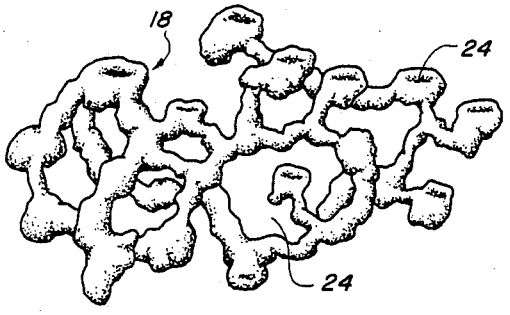
FIG. 3 is a three-dimensional view of a specially treated embodiment of the invention, where the nylon fibers and base fabric have been chemically removed after the forming process, leaving only the network of melted, low melting point material.

FIG. 3 is a three-dimensional illustration of the continuous phase (18) assumed by the material having the relatively lower melting point. A papermaker's fabric formed according to the claimed invention was treated with acid to dissolve the nylon. The remaining network of polypropylene was chemically separated from the base fabric. The voids (24) represent the locations of the removed nylon fibers and base fabric. FIG. 3 depicts the isolated polypropylene network.

Figure 4:
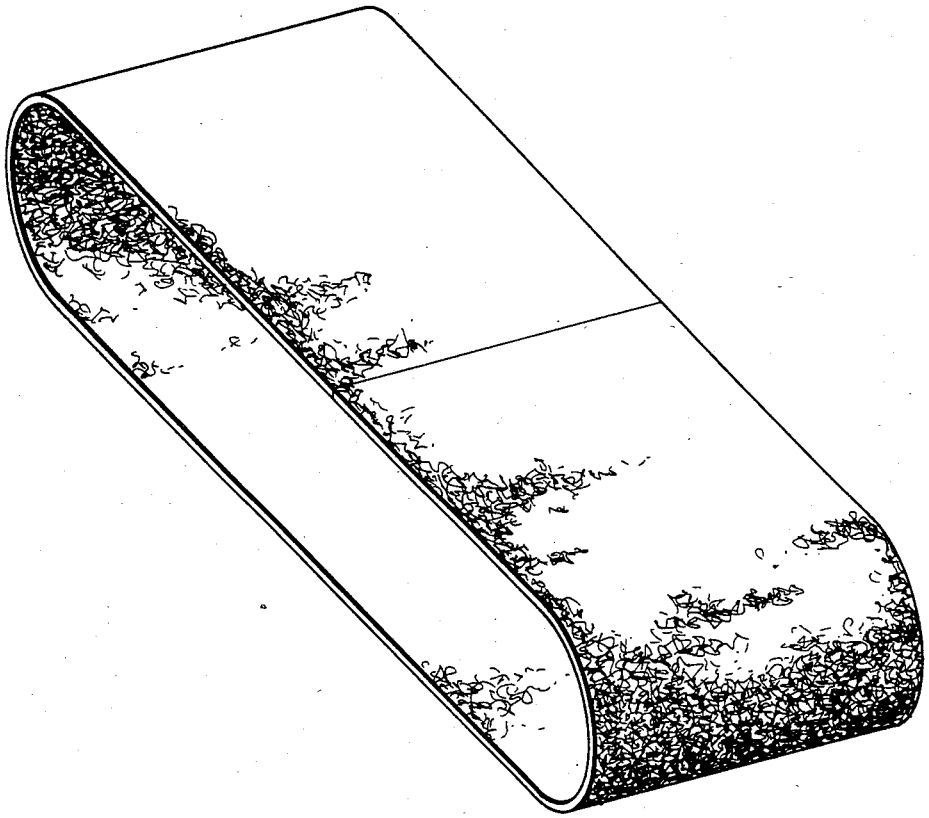
FIG. 4 is a three-dimensional view of the felt formed according to the invention formed into an endless belt.

FIG. 4 shows a felt formed according to the invention that has been formed into an endless belt.

The batt comprises between 75 and 90 percent by weight of fibers having a relatively high melting point and between 25 and 10 percent by weight of fusible material having a relatively low melting point. The preferred material with the relatively high melting point is nylon and the preferred material with the relatively low melting point is polypropylene (of a molecular weight over 50,000). If polypropylene and nylon are the materials used to form the batt, then the batt should contain approximately 90% by weight nylon fibers and approximately 10% by weight polypropylene.

A batt layer formed according to the invention can be utilized as a roll-contacting batt as well as a paper-contacting batt. In such a case, the batt layer provides a protective layer between the hard stainless steel rolls and the base layer so that the rolls will not wear away the base layer as quickly as they would wear it away without the protective layer.

The invention is further illustrated by the following non-limiting example.

EXAMPLE 1

A multilayer batt comprising 90% by weight of nylon 66 fibers from DuPont having a melting point of 250° C. and a molecular weight of 18,000, and 10% by weight polypropylene was produced by air blending the nylon fibers with the polypropylene. The polypropylene was a 3-10 denier TROFIL (trade mark) polypropylene fiber from Hercules having a melting point of 165° C. and a molecular weight of 52,000. A multi-chemical aqueous emulsion comprising 1.64% by weight oleic acid, 0.18% by weight polyoxysorbitan monolaurate, and 0.18% by weight ethoxylated phenol, for a total solid composition of 2% by weight, was applied to the batt to lubricate and isolate the system. The batt was needled to a base fabric forming a felt of 3.43 mm caliper. The felt was then cured at 185° C. at a rate of 0.9 m/minute. After curing, the felt was stretched to a caliper of 2.59 mm and then quenched in order to hold that thickness. The batt consisted of a layer of 440 g/m$^2$ in which the nylon fibers were 15 denier and a top layer of 220 g/m$^2$ in which the nylon fibers were 3 denier. The base fabric had the following specification:

10 weave base
MD yarns 184 TEX TM multifilament nylon 71/10 cm
CDM yarns 184 TEX TM multifilament nylon 79/10 cm It will of course be understood that the fabric described above is merely exemplary of felts manufactured in accordance with the invention. The formation of both the batt and the base fabric may be varied according to the application. The batt may be formed from any combination of suitable materials having the requisite melting points. The melting points of all batt materials must exceed the highest expected operating temperature of the papermaking machine. The melting point of at least one material must be relatively low as compared to the melting point of at least one other material. For example, two different types of nylon, one having a relatively lower temperature than the other, may be used. The batt may have one or more layers, of which individual layers may typically contain fibers of about 3 denier, about 15 denier, and about 40–60 denier, with the first layer nearest the outer surface of the felt. The size of the polypropylene fibers or material having the lower melting point is not critical provided that they will provide the necessary bonding action. The amount of the lower melting point material must be sufficient to form a continuous phase over the entire area of the felt. The base fabric may be a monofilament fabric, a mixed fabric or a multilayer fabric. It may be woven or non-woven. A batt formed according to the invention may also be applied to the roller side of fabric, as discussed above.

The various embodiments, terms and references to a particular material which have been employed herein are used only by way of description and not of limitation, and there is no intention for any of the above to exclude any thereof. Hence, it is recognized that various modifications are possible within the scope of the present invention as claimed.

Having thus described our invention, we claim:

1. A papermaker's felt for use with a paper-making machine comprising:

a base layer of fabric formed into a belt, and a batt layer having a major portion of a discontinuous phase which includes fibers having a relatively high melting point, and a minor portion of a continuous phase which includes fusible material, said continuous phase also defining channels for the drainage of water, said fusible material having a melting point lower than the melting point of the fibers of said discontinuous phase and higher than the highest expected operating temperature of the papermaking machine, said fusible material fused to said fibers and said base layer.

2. The papermaker's felt of claim 1 wherein said fibers of said discontinuous phase are nylon.

3. The papermaker's felt of claim 1 wherein said fusible material is polypropylene.

4. The papermaker's felt of claim 1 wherein said fusible materials is nylon.

5. The papermaker's felt of claim 1 wherein said fibers of said discontinuous phase comprise approximately 90% by weight of the batt layer.

6. The papermaker's felt of claim 1 wherein said fabric base layer is impregnated through its entire thickness by said fusible material.

7. The papermaker's felt of claim 1 wherein said batt layer is joined to said base layer by needling in a needle loom.

8. The papermaker's felt of claim 1 wherein said batt layer is joined to said base layer by use of adhesives.

9. The papermaker's felt of claim 1 wherein said fusible material is in the form of fibers.

10. The method of making a papermaker's felt for use with a papermaking machine comprising the steps of forming a base layer from a fabric, forming a batt layer by utilizing a major portion of fibers having a relatively high melting point in combination with a minor portion of fusible material having a relatively low melting point, where said relatively low melting point is greater than the highest expected operating temperature of the papermaking machine, said fusible material being present in an amount sufficient to form a continuous phase, joining said batt layer to said base layer, heating said joined layers to a temperature below the melting point of said fibers and above the melting point of said fusible material, said fusible material fusing to itself, and fusing to said fibers and said base layer, thereby resulting in a batt layer having a fused continuous phase and a discontinuous fiber phase, said fused continuous phase also defining channels for the drainage of water, and forming the felt into a belt.

11. The method of claim 10 wherein said fusible material is in the form of fibers.

12. The method of claim 10 wherein said step of joining said batt layer to said base layer is accomplished by needling in a needle loom.

13. The method of claim 10 wherein said step of joining said batt layer to said base layer is accomplished by use of adhesives.

* * * * *

UNITED STATES PATENT AND TRADEMARK OFFICE

CERTIFICATE OF CORRECTION

PATENT NO. : 4,565,735

DATED : January 21, 1986

INVENTOR(S) : August Murka, Jr. and Michael Marcellus

It is certified that error appears in the above-identified patent and that said Letters Patent are hereby corrected as shown below:

Title page:

Item [21] Appl. No., delete "621,503" and substitute therefor --662,503--.

Column 1, line 29, delete "so" and substitute therefor --do--

Column 1, line 62, delete "of" (1st occurr.) and substitute therefor --or--

Signed and Sealed this

*Sixth* Day of *May 1986*

[SEAL]

*Attest:*

DONALD J. QUIGG

*Attesting Officer*

*Commissioner of Patents and Trademarks*